US011792595B2

(12) United States Patent
Lee

(10) Patent No.: US 11,792,595 B2
(45) Date of Patent: Oct. 17, 2023

(54) SPEAKER TO ADJUST ITS SPEAKER SETTINGS

(71) Applicant: Microchip Technology Incorporated, Chandler, AZ (US)

(72) Inventor: Tik Man Lee, Chandler, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 1 day.

(21) Appl. No.: 17/647,202

(22) Filed: Jan. 6, 2022

(65) Prior Publication Data

US 2022/0369060 A1 Nov. 17, 2022

Related U.S. Application Data

(60) Provisional application No. 63/186,938, filed on May 11, 2021.

(51) Int. Cl.
*H04S 7/00* (2006.01)

(52) U.S. Cl.
CPC ..... *H04S 7/301* (2013.01); *H04S 7/307* (2013.01)

(58) Field of Classification Search
CPC ..... H04S 7/301; H04S 7/307
USPC ..... 381/303
See application file for complete search history.

(56) References Cited

U.S. PATENT DOCUMENTS 7,676,044 B2 3/2010 Sasaki et al.
9,426,598 B2 8/2016 Walsh et al.
10,861,465 B1 12/2020 Vines et al.
2005/0152557 A1 7/2005 Sasaki et al.
2014/0369505 A1* 12/2014 Lee ..... H04R 3/12 381/17
2016/0309258 A1 10/2016 Hiscock et al.
2018/0242095 A1 8/2018 Patil et al.
2019/0215634 A1* 7/2019 Doolittle ..... H04S 7/30
2020/0366994 A1 11/2020 Arteaga et al.

OTHER PUBLICATIONS

International Search Report from International Application No. PCT/US2022/070061, dated Apr. 29, 2022, 5 pages.
International Written Opinion from International Application No. PCT/US2022/070061, dated Apr. 29, 2022, 6 pages.

* cited by examiner

*Primary Examiner* — Vivian C Chin
*Assistant Examiner* — Douglas J Suthers
(74) *Attorney, Agent, or Firm* — TraskBritt

(57) ABSTRACT

Examples disclosed herein include a speaker. The speaker may include a group of microphones and a processor. The processor may determine a first speaker-channel identifier for a multi-speaker system at least partially responsive to a first tone captured at the group of microphones. The processor may also determine a position of a source of the captured first tone relative to the speaker at least partially responsive to position information derived from the captured first tone. The processor may also determine a second speaker-channel identifier at least partially responsive to the first speaker-channel identifier and the position of the source of the captured first tone. The processor may also determine speaker settings at least partially responsive to the second speaker-channel identifier. Related devices, systems and methods are also disclosed.

26 Claims, 9 Drawing Sheets

SPEAKER TO ADJUST ITS SPEAKER SETTINGS

CROSS-REFERENCE TO RELATED APPLICATION

This application claims the benefit of the priority date of U.S. Provisional Patent Application No. 63/186,938, filed May 11, 2021, and titled "SELF-TUNING MULTI-SPEAKER SYSTEM," the disclosure of which is incorporated herein in its entirety by this reference.

TECHNICAL FIELD

This description relates, generally, to a multi-speaker system. More specifically, some examples relate to a self-tuning multi-speaker system, without limitation. Additionally, devices, systems, and methods are disclosed.

BACKGROUND

A multi-speaker system (e.g., a 5.1 surround sound system, a 7.1 surround sound system, or a 9.1 surround sound system, without limitation) may be designed to have multiple speakers arranged at particular locations relative to a specific location, e.g., a listener's position. In some multi-speaker systems, each of the speakers may be intended to have specific speaker settings, e.g., related to the particular location of the respective speaker.

BRIEF DESCRIPTION OF THE DRAWINGS

While this disclosure concludes with claims particularly pointing out and distinctly claiming specific examples, various features and advantages of examples within the scope of this disclosure may be more readily ascertained from the following description when read in conjunction with the accompanying drawings, in which:

DETAILED DESCRIPTION

Figure 1:
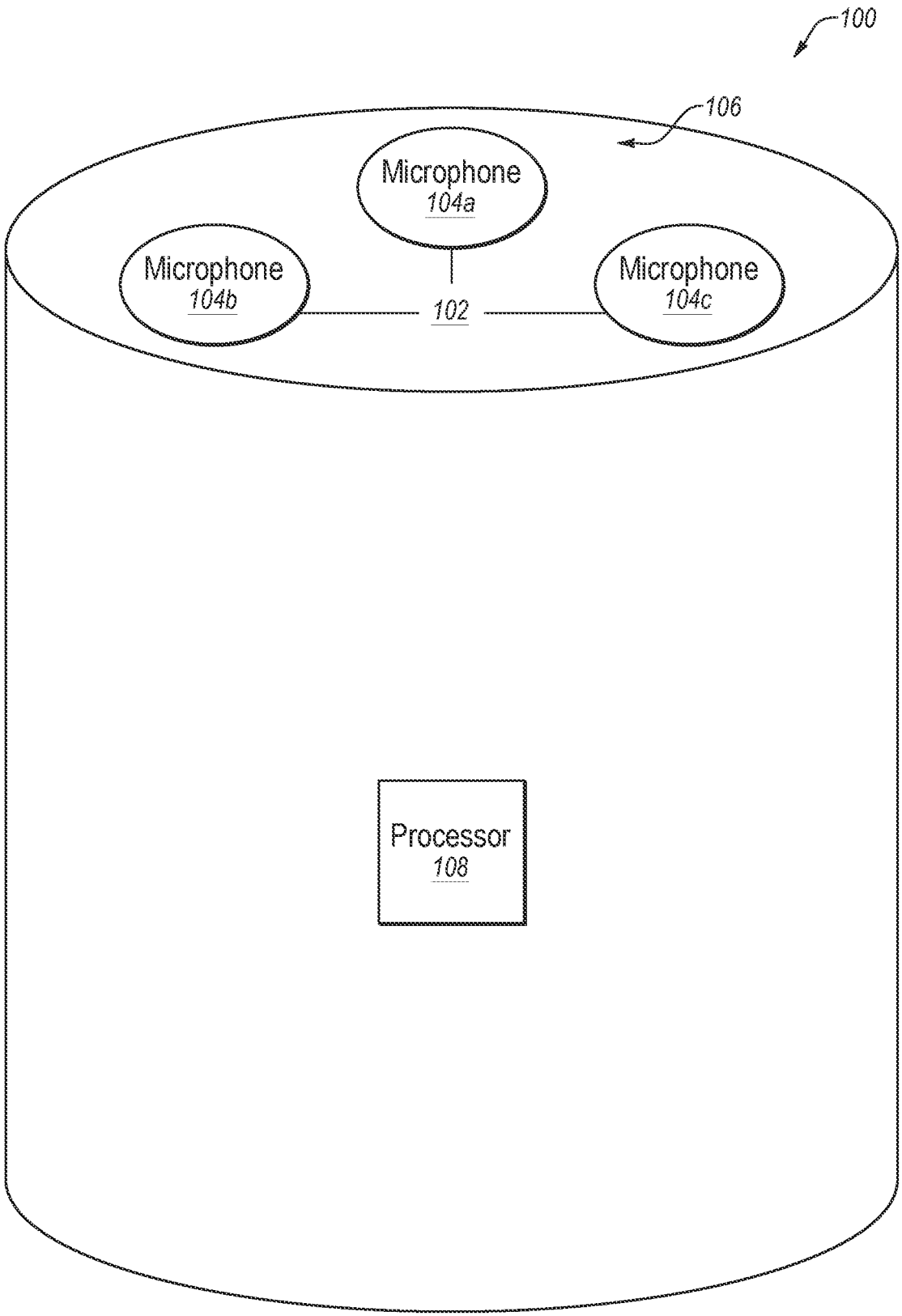
FIG. 1 is a functional block diagram illustrating an example speaker according to one or more examples.

In the following detailed description, reference is made to the accompanying drawings, which form a part hereof, and in which are shown, by way of illustration, specific examples of examples in which the present disclosure may be practiced. These examples are described in sufficient detail to enable a person of ordinary skill in the art to practice the present disclosure. However, other examples may be utilized, and structural, material, and process changes may be made without departing from the scope of the disclosure.

The illustrations presented herein are not meant to be actual views of any particular method, system, device, or structure, but are merely idealized representations that are employed to describe the examples of the present disclosure. The drawings presented herein are not necessarily drawn to scale. Similar structures or components in the various drawings may retain the same or similar numbering for the convenience of the reader; however, the similarity in numbering does not mean that the structures or components are necessarily identical in size, composition, configuration, or any other property.

The following description may include examples to help enable one of ordinary skill in the art to practice the disclosed examples. The use of the terms "exemplary," "by example," and "for example," means that the related description is explanatory, and though the scope of the disclosure is intended to encompass the examples and legal equivalents, the use of such terms is not intended to limit the scope of an example of this disclosure to the specified components, steps, features, functions, or the like.

It will be readily understood that the components of the examples as generally described herein and illustrated in the drawing could be arranged and designed in a wide variety of different configurations. Thus, the following description of various examples is not intended to limit the scope of the present disclosure, but is merely representative of various examples. While the various aspects of the examples may be presented in drawings, the drawings are not necessarily drawn to scale unless specifically indicated.

Furthermore, specific implementations shown and described are only examples and should not be construed as the only way to implement the present disclosure unless specified otherwise herein. Elements, circuits, and functions may be depicted by block diagram form in order not to obscure the present disclosure in unnecessary detail. Conversely, specific implementations shown and described are exemplary only and should not be construed as the only way to implement the present disclosure unless specified otherwise herein. Additionally, block definitions and partitioning of logic between various blocks is exemplary of a specific implementation. It will be readily apparent to one of ordinary skill in the art that the present disclosure may be practiced by numerous other partitioning solutions. For the most part, details concerning timing considerations and the like have been omitted where such details are not necessary to obtain a complete understanding of the present disclosure and are within the abilities of persons of ordinary skill in the relevant art.

Those of ordinary skill in the art would understand that information and signals may be represented using any of a variety of different technologies and techniques for the other speaker of the multi-speaker system. For example, data, instructions, commands, information, signals, bits, and symbols that may be referenced throughout this description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal. A person having ordinary skill in the art would appreciate that this disclosure encompasses communication of quantum information and qubits used to represent quantum information.

The various illustrative logical blocks, modules, and circuits described in connection with the examples disclosed herein may be implemented or performed with a general purpose processor, a special purpose processor, a Digital Signal Processor (DSP), an Integrated Circuit (IC), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor (may also be referred to herein as a host processor or simply a host) may be a microprocessor, but in the alternative, the processor may be any conventional processor, controller, microcontroller, or state machine. A processor may also be implemented as a combination of computing devices, such as a combination of a DSP and a microprocessor, a plurality of microprocessors, one or more microprocessors in conjunction with a DSP core, or any other such configuration. A general-purpose computer including a processor is considered a special-purpose computer while the general-purpose computer is configured to execute computing instructions (e.g., software code) related to examples of the present disclosure.

The examples may be described in terms of a process that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be re-arranged. A process may correspond to a method, a thread, a function, a procedure, a subroutine, or a subprogram, without limitation. Furthermore, the methods disclosed herein may be implemented in hardware, software, or both. If implemented in software, the functions may be stored or transmitted as one or more instructions or code on computer-readable media. Computer-readable media includes both computer storage media and communication media including any medium that facilitates transfer of a computer program from one place to another.

A multi-speaker system (e.g., a 5.1 surround sound system, a 7.1 surround sound system, or a 9.1 surround sound system, without limitation) may be designed to have multiple speakers arranged at particular locations relative to a specific location, e.g., a listener's position, without limitation. As a non-limiting example, a multi-speaker system may be designed to include a speaker positioned in front of a specific location, a speaker in front of and to the left of the specific location, a speaker in front of and to the right of the specific location, a speaker behind and to the left of the specific location, and a speaker behind and to the right of the specific location. In some multi-speaker systems, each of the speakers may be intended to have specific speaker settings, e.g., related to the particular location of the respective speaker, without limitation. The speaker settings may include one or more of an audio channel, a frequency range, and a volume level.

Some multi-speaker systems may include speakers specifically designed or tuned to be placed in a particular location relative to the listener's position. As a non-limiting example, a multi-speaker system may come out of the box with a designation for each of the speakers and an intended location for placement of each of the speakers. Placing each of the speakers in the intended location accurately may be difficult, time consuming, or impractical in some situations.

Some multi-speaker systems (including multi-speaker systems with designations for each speaker) may be designed to be tuned (i.e., have speaker settings adjusted) after installation in a room. As a non-limiting example, a multi-speaker system may be designed to be installed in a room, e.g., by a professional installer, and then to be tuned based on the installation.

Examples of the present disclosure include a multi-speaker system that may automatically tune itself, i.e., a self-tuning multi-speaker system. As a non-limiting example, some examples include one or more speakers that may automatically tune themselves, i.e., self-tuning speakers. As a non-limiting example, each of the one or more speakers may determine one or more speaker settings for itself.

Examples of the present disclosure include a speaker that may capture a tone from a neighboring speaker, determine an other speaker-channel identifier of the neighboring speaker responsive to the captured tone, determine a relative position of the neighboring speaker relative to the speaker, determine an own speaker-channel identifier responsive to the other speaker-channel identifier and determine the position of the speaker relative to the position of the neighboring speaker (also referred to herein as the relative position of the neighboring speaker). The speaker may further determine speaker settings responsive to the own speaker-channel identifier. The speaker may further adjust its own speaker settings responsive to the determined speaker settings.

A speaker-channel identifier may be an indication of a role or position of a speaker in multi-speaker system. A speaker-channel identifier may be related to one or more of an audio channel and speaker settings. Non-limiting examples of speaker-channel identifiers include: "center," "front high right," "front high left," "subwoofer," "front right," "front left," "side right," "side left," "side back right," and "side back left."

FIG. 1 is a functional block diagram illustrating a speaker 100 according to one or more examples. In one or more examples, speaker 100 may determine an own speaker-channel identifier (e.g., based on an other speaker-channel identifier of an other speaker and a relative position of the other speaker, without limitation), determine speaker settings for itself, or adjust its own speaker settings. In the specific non-limiting example depicted by FIG. 1, speaker 100 includes group of microphones 102 (including microphone 104*a*, microphone 104*b*, and microphone 104*c*) that exhibit a spaced arrangement 106, and further includes processor 108.

Group of microphones 102 may capture sounds including tones, e.g., output by other speakers, without limitation. Spaced arrangement 106 may be such that each microphone of group of microphones 102 is spaced apart from other microphones of group of microphones 102. Additionally or alternatively, spaced arrangement 106 may be such that at least three microphones of group of microphones 102 are arranged not in a straight line. As a non-limiting example, spaced arrangement 106 may be a triangular arrangement for a group of microphones 102 including three microphones.

Processor 108 may be, or may include, one or more processors. Processor 108 may, among other things, receive signals from group of microphones 102 indicative of captured sounds (e.g., a tone output by an other speaker, without limitation) and determine a relative position of a source of a captured sound (e.g., the relative position of the other speaker, without limitation). The determination of the relative position may be at least partially responsive to position information derived from the captured sound. As a non-limiting example, processor 108 may determine a direction of a source of a sound at least partially responsive to a time of arrival of the sound at each microphone of group of microphones 102. Further, processor 108 may determine a distance to the source at least partially responsive to a volume of the sound.

Processor 108 may determine an other speaker-channel identifier for an other speaker of a multi-speaker system at least partially responsive to a tone captured at group of microphones 102. As a non-limiting example, processor 108 may compare a frequency of the tone (i.e., a "tone frequency") to a list including one or more associations between frequencies and speaker-channel identifiers.

Processor 108 may determine an own speaker-channel identifier at least partially responsive to the other speaker-channel identifier and the relative position of the other speaker. In one or more examples, the term "own speaker-channel identifier" may refer to an indication of a role or position of a speaker in multi-speaker system from the perspective of the speaker. For example, if a speaker determines a speaker-channel identifier for itself, e.g., for the speaker to take the role or position associated with that speaker-channel identifier, the speaker has determined its own speaker-channel identifier.

As a non-limiting example, processor 108 may determine its own speaker-channel identifier based on a determination of a direction from which a tone emanated (the tone having emanated from an other speaker, as a non-limiting example) and based on the other speaker-channel identifier (associated with the tone). As a non-limiting example, if speaker 100 receives (at group of microphones 102) a tone from its right, and a tone frequency of the tone is associated with an other speaker-channel identifier identifying the source of tone as a "side back right" speaker, speaker 100 may determine that speaker 100 is a "side back left" speaker.

Processor 108 may determine speaker settings responsive to the own speaker-channel identifier. As a non-limiting example, based on a determination that speaker 100 is a "side back left" speaker, processor 108 may determine appropriate speaker settings. The speaker settings may include one or more of an audio channel for speaker 100, a frequency range for speaker 100, and a volume for speaker 100. In various examples, processor 108 may adjust speaker settings of speaker 100 according to the determined speaker settings.

In various examples, processor 108 may further determine a relative location of a specific location (e.g., a potential location for a listener, without limitation) and determine speaker settings for speaker 100 based on the specific location. As a non-limiting example, group of microphones 102 may capture a listener tone or broadcast that emanated from the specific location. Processor 108 may determine a relative location of the specific location (e.g., as described above with regard to determining the location of the source of a sound, without limitation). Processor 108 may determine speaker settings for speaker 100 at least partially responsive to the relative location of the specific location. As a non-limiting example, processor 108 may determine a volume for speaker 100 at least partially responsive to a distance from speaker 100 to the specific location.

Figure 2:
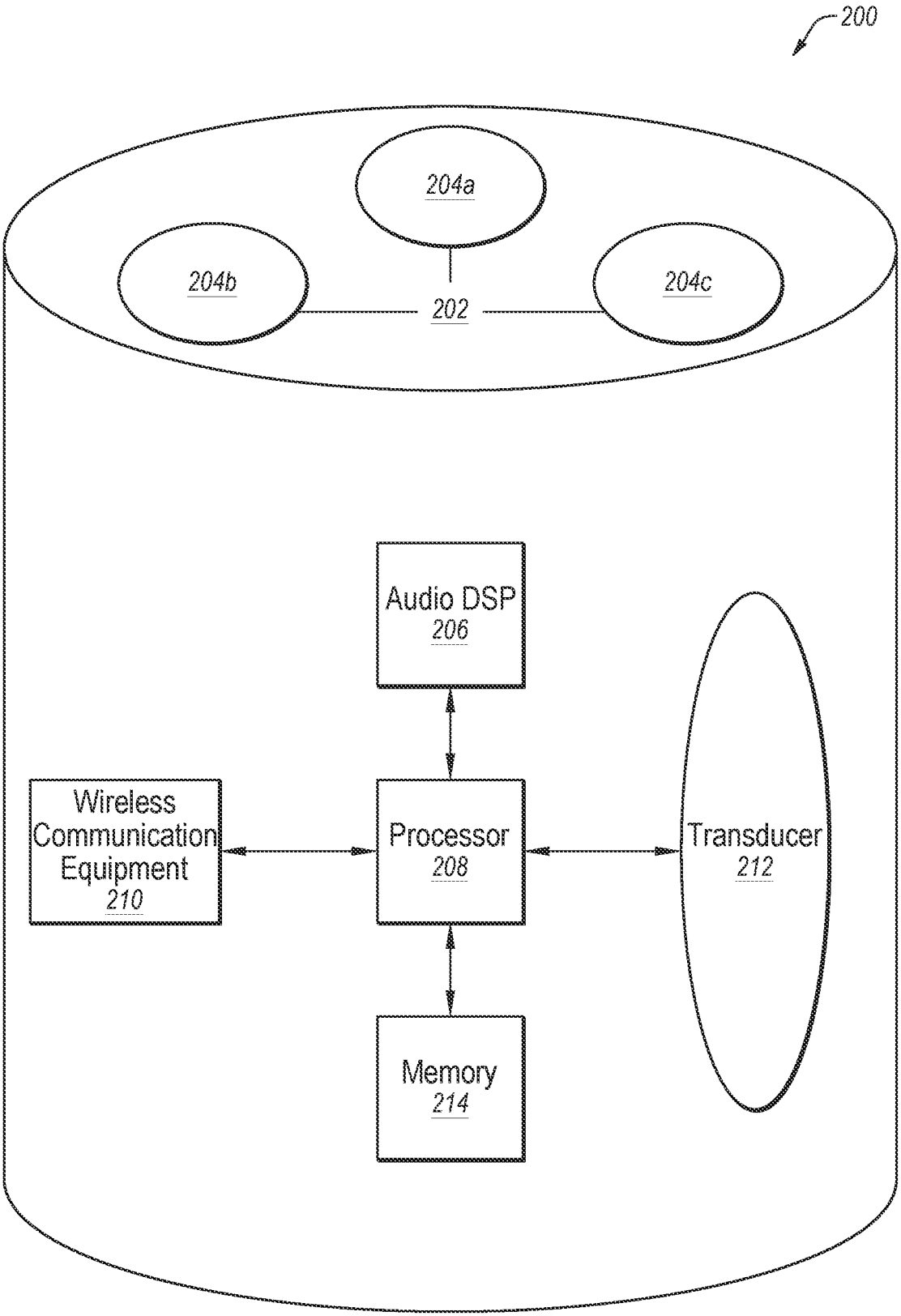
FIG. 2 is a functional block diagram illustrating an example speaker according to one or more examples.

FIG. 2 is a functional block diagram illustrating an example speaker 200 according to one or more examples. Speaker 200 may be an example of speaker 100 of FIG. 1. Speaker 200 includes group of microphones 202 (including microphone 204*a*, microphone 204*b*, and microphone 204*c*), which may be the same as or substantially similar to group of microphones 102 (including microphone 104*a*, microphone 104*b*, and microphone 104*c*) of speaker 100 of FIG. 1. Speaker 200 also includes processor 208, which may be the same as or substantially similar to processor 108 of speaker 100 of FIG. 1. Additionally, speaker 200 includes audio DSP 206, wireless communication equipment 210, transducer 212, and memory 214.

Wireless communication equipment 210 may receive and transmit information wirelessly. Wireless communication equipment 210 may be, or may include, any suitable component or system for communicating wirelessly according to any suitable protocol. As a non-limiting example, wireless communication equipment 210 may include a BLUETOOTH®-capable communication equipment, or an Institute of Electrical and Electronics Engineers (IEEE) 802.11-capable communication equipment, or a ZigBee-capable communication equipment.

Transducer 212 may output sound. Transducer 212 may receive an electrical signal from processor 208 and translate the electrical signal into sound. As a non-limiting example, speaker 200 may receive a wireless signal at wireless communication equipment 210, the wireless signal may include audio information. (Alternatively, speaker 200 may receive a signal including audio information at a wire (not illustrated).) Processor 208 may cause transducer 212 to output sound based on the received audio information.

Audio DSP 206 may process audio information. Audio DSP 206 may be, or may include, any suitable processor or one or more processors. In various examples, audio DSP 206 may process audio information before the audio information is provided to transducer 212. Additionally or alternatively, audio DSP 206 may process audio information received at group of microphones 202, e.g., when determining a location of a source of a tone.

Memory 214 may store information and may further store instructions for processor 208. Memory 214 may include any suitable computer memory.

Speaker 200 may utilize one or more of audio DSP 206, wireless communication equipment 210, memory 214 and transducer 212 to determine a speaker-channel identifier and speaker settings for speaker 200 and to adjust speaker 200 according to the determined speaker settings. Further, speaker 200 may utilize one or more of audio DSP 206, wireless communication equipment 210, memory 214 and transducer 212 to cause speaker 200 to aid other speakers of a multi-speaker system to determine one or more of their speaker-channel identifiers and speaker settings (e.g., by playing a tone and/or broadcasting the determine speaker-channel identifier).

As a non-limiting example, processor 208 (alone or in conjunction with audio DSP 206) may determine a relative location of a source of a sound (e.g., a tone emanating from another speaker or a listener tone emanating from a specific location, without limitation) based on the sound as captured at group of microphones 202. As described above, processor 208 (alone or in conjunction with audio DSP 206) may determine the relative location based on a time of arrival of a sound at each of group of microphones 202 or a volume of the sound at group of microphones 202. Speaker 200 may store the determined relative locations at memory 214.

Additionally or alternatively, processor 208 may cause transducer 212 to produce a tone. A tone frequency of the tone may be associated with a speaker-channel identifier of speaker 200. The tone may be used by other speakers of a multi-speaker system to one or more of determine a relative location of speaker 200 and associate a speaker-channel identifier with the determined relative location of speaker 200. The determined relative location of speaker 200 and the speaker-channel identifier of speaker 200 may be used by other speakers of the multi-speaker system in determining their own speaker-channel identifiers.

As another non-limiting example, wireless communication equipment 210 may receive information about an other speaker of the multi-speaker system (i.e., "identifying information"). The information may include one or more of an other speaker-channel identifier and a tone frequency of a tone that may be output by the other speaker. Processor 208 may use the identifying information regarding one or more of the tone frequency and the other speaker-channel identifier when associating a relative location of a captured tone with a speaker-channel identifier. As a non-limiting example, speaker 200 may store the received identifying information at memory 214. Additionally or alternatively, memory 214 may have identifying information (including, e.g., associations between tone frequencies and speaker-channel identifiers) pre-loaded. Additionally or alternatively, speaker 200 may store associations between speaker-channel identifiers and relative locations at memory 214.

Additionally or alternatively, wireless communication equipment 210 may transmit identifying information about speaker 200 (e.g., one or more of an own speaker-channel identifier and a tone frequency of a tone that may be output by speaker 200, without limitation). The transmitted identifying information, (i.e., the speaker-channel identifier of speaker 200 and the tone frequency) may be used by other speakers of the multi-speaker system in determining their own speaker-channel identifiers.

As another non-limiting example, in various examples, processor 208 may determine a relative location of a specific location (e.g., a potential location for a listener, without limitation) based on wireless transmissions received at wireless communication equipment 210 or based on a listener tone received by microphones 204. As a non-limiting example, wireless communication equipment 210 may receive a wireless signal from the specific location. Processor 208 may determine the specific location based on the wireless signal. As a non-limiting example, wireless communication equipment 210 may include a directional antenna and processor 208 in conjunction with wireless communication equipment 210 may determine the specific location based on signal strength at the directional antenna. As another example, the wireless signal may indicate the specific location.

Figure 3:
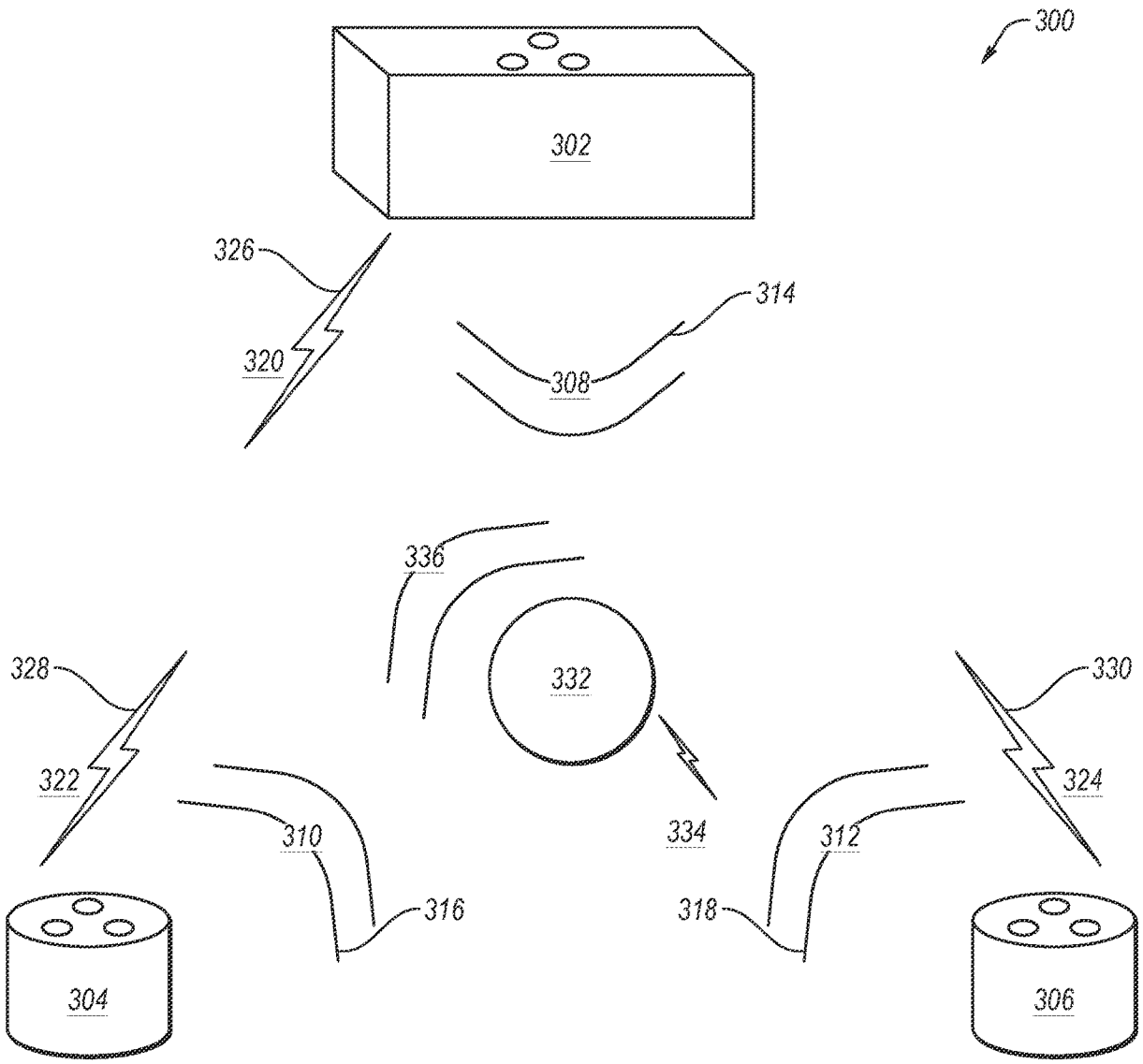
FIG. 3 is a functional block diagram illustrating an example system according to one or more examples.

FIG. 3 is a functional block diagram illustrating an example multi-speaker system 300 according to one or more examples. Each of the speakers of multi-speaker system 300 may determine and may apply its own speaker settings. Multi-speaker system 300 includes first speaker 302, second speaker 304, and third speaker 306. First speaker 302 may output tone 308 (exhibiting tone frequency 314) and broadcast wireless signal 320 (encoding at least identifying information 326). Second speaker 304 may output tone 310 (exhibiting tone frequency 316) and broadcast wireless signal 322 (encoding at least identifying information 328). Third speaker 306 may output tone 312 (exhibiting tone frequency 318) and broadcast wireless signal 324 (encoding at least identifying information 330). Additionally, in various examples, wireless signal 334 may be broadcast from specific location 332, listener tone 336 may be output from specific location 332, or both wireless signal 334 may be broadcast from specific location 332 and listener tone 336 may be output from specific location 332.

Each of first speaker 302, second speaker 304, and third speaker 306 may be an example of speaker 100 of FIG. 1 or an example of speaker 200 of FIG. 2. Each of first speaker 302, second speaker 304, and third speaker 306 may perform one or more operations to determine and apply its own speaker settings.

As an example of operations of multi-speaker system 300, each of first speaker 302, second speaker 304, and third speaker 306 may determine a speaker-channel identifier for itself. The determined speaker-channel identifier may be initial, e.g., the determined speaker-channel identifier may be preliminary, subject to further determination, update, or based on limited information, without limitation.

Continuing the example, each of first speaker 302, second speaker 304, and third speaker 306 may broadcast a wireless signal indicative of information about the respective speaker (i.e., identifying information including the determined speaker-channel identifier). As a non-limiting example, first speaker 302 may broadcast wireless signal 320 indicative of identifying information 326 about first speaker 302, second speaker 304 may broadcast wireless signal 322 indicative of identifying information 328 about second speaker 304, and third speaker 306 may broadcast wireless signal 324 indicative of identifying information 330 about third speaker 306.

Each of identifying information 326, identifying information 328, and identifying information 330, may include a respective speaker-channel identifier (e.g., the initial speaker-channel identifier, without limitation) of a respective speaker and a tone frequency (i.e., of a tone that may be output by the respective speaker). As a non-limiting example, identifying information 326 may include a speaker-channel identifier of first speaker 302 and a tone frequency 314 of a tone to be output by first speaker 302, identifying information 328 may include a speaker-channel identifier of second speaker 304 and a tone frequency 316 of a tone to be output by second speaker 304, and identifying information 330 may include a speaker-channel identifier of third speaker 306 and a tone frequency 318 of a tone to be output by third speaker 306.

Continuing the example, each of first speaker 302, second speaker 304, and third speaker 306 may receive wireless signals from the others of first speaker 302, second speaker 304, and third speaker 306. Each of first speaker 302, second speaker 304, and third speaker 306 may store associations between tone frequencies and speaker-channel identifiers.

Continuing the example, each of first speaker 302, second speaker 304, and third speaker 306 may output a tone at a respective tone frequency. The respective frequencies may be the same as the respective frequencies included in the respective identifying information. As a non-limiting example, first speaker 302 may output tone 308 exhibiting tone frequency 314, second speaker 304 may output tone 310 exhibiting tone frequency 316, and third speaker 306 may output tone 312 exhibiting tone frequency 318.

Continuing the example, each of first speaker 302, second speaker 304, and third speaker 306 may capture tones from the others of first speaker 302, second speaker 304, and third speaker 306. Further, each of first speaker 302, second speaker 304, and third speaker 306 may determine a relative location of a source of the respective captured tones. As a non-limiting example, first speaker 302 may receive tone 310 and tone 312. First speaker 302 may include a group of microphones and may determine a respective relative direction from which each of tone 310 and tone 312 arrived at first speaker 302. First speaker 302 may further determine a respective distance from first speaker 302 to the sources of tone 310 and tone 312.

Continuing the example, each of first speaker 302, second speaker 304, and third speaker 306 may associate determined relative locations with speaker-channel identifiers based on the associations between tone frequencies and speaker-channel identifiers (e.g., as found in the identifying information included in the wireless signals, without limitation) and based on the determined relative locations of the sources of the tones (each of the tones exhibiting a tone frequency). As a non-limiting example, first speaker 302 may associate a determined relative location of a source of tone 310 with a speaker-channel identifier received in identifying information 328 because tone frequency 316 of tone 310 matches tone frequency 316 included in identifying information 328. Also, first speaker 302 may associate a determined relative location of a source of tone 312 with a speaker-channel identifier received in identifying information 330 because tone frequency 318 of tone 312 matches tone frequency 318 included in identifying information 330.

Continuing the example, based on one or more determined relative locations and associated speaker-channel identifiers, each of first speaker 302, second speaker 304, and third speaker 306 may determine its own speaker-channel identifier. In some cases, as a non-limiting example, where a speaker previously determined an initial speaker-channel identifier, the speaker may update its speaker-channel identifier. As a non-limiting example, if first speaker 302 determines that first speaker 302 received tone 310 from its right, and that tone 310 is associated with a speaker-channel identifier indicative of "side left," first speaker 302 may determine that first speaker 302 is a "center" speaker. First speaker 302 may accordingly update its speaker-channel identifier to "center."

In some cases, a speaker may assume its orientation (i.e., an orientation of its group of microphones relative to the other speakers), e.g., based on which side a transducer of the speaker is on and based on an assumption that it is positioned with the transducer pointed towards a center of a listening space. In other cases, a speaker may not assume an orientation and may use two or more relative locations to determine its orientation and thereafter determine relative locations.

Continuing the example, after determining or updating its own speaker-channel identifier, each of first speaker 302, second speaker 304, and third speaker 306 may broadcast a wireless signal including its speaker-channel identifier, i.e., its updated speaker-channel identifier.

In some cases, it may take two or more rounds of broadcasting speaker-channel identifiers, associating speaker-channel identifiers with relative locations, and updating speaker-channel identifiers to arrive at a stable solution in which each of the speakers does not update its speaker-channel identifier.

Although the speaker-channel identifiers may be updated, each speaker may retain a tone frequency (i.e., a frequency of a tone that may be broadcast by the speaker). Further, multi-speaker system 300 may operate under the assumption that the speakers are not moved between rounds of broadcasting wireless signals. Thus, the relative locations and associated frequencies may remain constant and the speakers may not need to repeat outputting of tones.

Continuing the example, after determining its own speaker-channel identifier, each speaker may determine speaker settings for itself. As a non-limiting example, there may be speaker settings associated with each speaker-channel identifier. As a non-limiting example, a "center" speaker may be associated with certain speaker settings and a "back-side-left" speaker may be associated with certain other speaker settings. In various examples, each of the speakers may adjust its speaker settings to match the determined speaker settings.

Additionally or alternatively, a wireless signal 334 may be broadcast from specific location 332 and/or listener tone 336 may be output from specific location 332. As a non-limiting example, a user device (e.g., a smart phone, tablet, or laptop of a listener, without limitation) may broadcast wireless signal 334 and/or output listener tone 336. Specific location 332 may be an intended location of a listener (e.g., surrounded by multi-speaker system 300, without limitation). Each of first speaker 302, second speaker 304, and third speaker 306 may receive wireless signal 334 and/or listener tone 336 and to determine a relative location of specific location 332 based thereon. In some examples, wireless signal 334 may indicate the specific location 332 or the relative location of the specific location 332. In other examples, each of first speaker 302, second speaker 304 and third speaker 306 may determine the location of specific location 332 based on the signal strength and the direction of wireless signal 334 as received at wireless-communication equipment of the respective speakers and/or based on the volume and direction of listener tone 336 as received at microphones of the respective speakers. Further, each of first speaker 302, second speaker 304, and third speaker 306 may determine or apply speaker settings based on the determined relative location of specific location 332.

Figure 4:
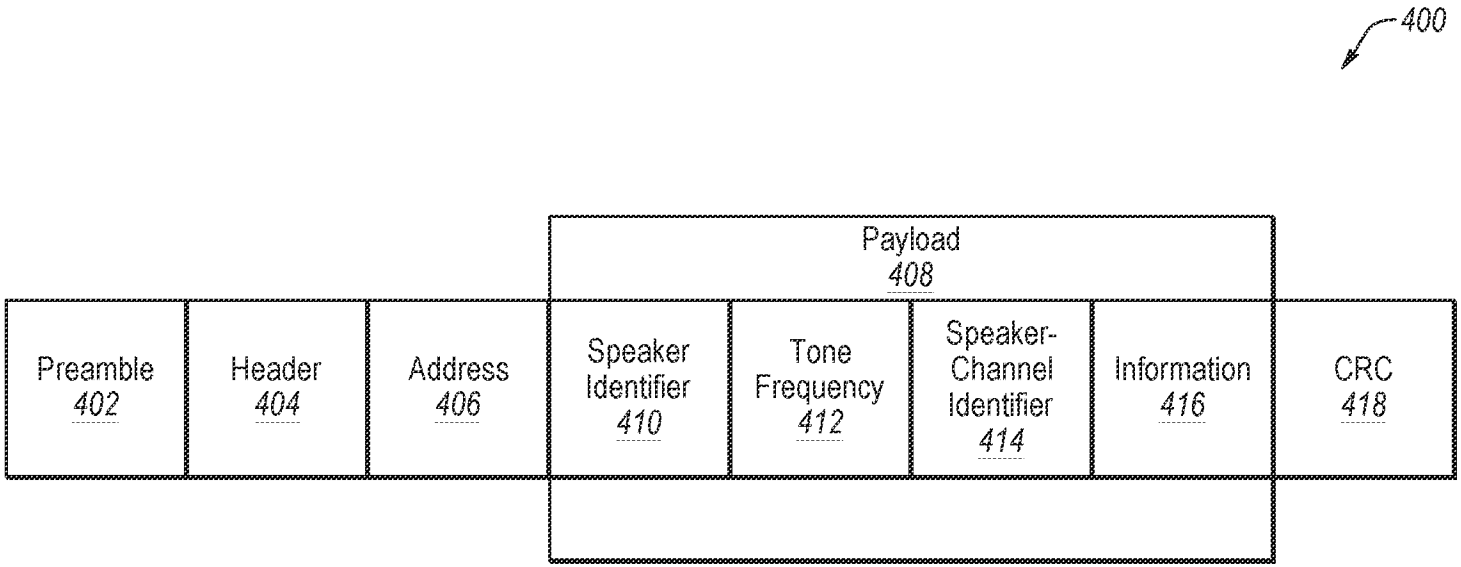
FIG. 4 is a block diagram illustrating an example communication according to one or more examples.

FIG. 4 is a block diagram illustrating an example communication 400 according to one or more examples. Communication 400 includes a preamble 402, a header 404, an address 406, a payload 408, and a cyclic redundancy check (CRC) 418.

Communication 400 may be an example of information encoded in a wireless signal broadcast by a speaker in a multi-speaker system. As a non-limiting example, communication 400 may be an example of information encoded in any of wireless signal 320, wireless signal 322, or wireless signal 324 of FIG. 3.

Payload 408 may be an example of identifying information (e.g., any of identifying information 326, identifying information 328, or identifying information 330 of FIG. 3, without limitation). Payload 408 may include a speaker identifier 410, a tone frequency 412, a speaker-channel identifier 414, and information 416.

Speaker identifier 410 may be indicative of the speaker that broadcast communication 400. In various examples, speaker identifier 410 may be independent of a role of the speaker in a multi-speaker system (e.g., independent of speaker-channel identifier 414). Each speaker may retain its speaker identifier 410 through multiple rounds of updating its speaker-channel identifier 414. In various examples, speaker identifier 410 may be interpreted as an indication of an intended role of the speaker in a multi-speaker system. As a non-limiting example, a "center" speaker may be (e.g., hard-wired, without limitation) with a speaker identifier 410 of "1." The speaker may use the indication to determine its initial speaker-channel identifier, however, the speaker may update its initial speaker-channel identifier as the speaker receives information from other speakers.

Tone frequency 412 may be a frequency of a tone that may be output by the speaker. Tone frequency 412 may be independent of a role of the speaker in a multi-speaker system (e.g., independent of speaker-channel identifier 414). Each speaker may retain its tone frequency 412 through multiple rounds of updating its speaker-channel identifier 414. Non-limiting examples of suitable frequencies include 3 kilohertz (kHz), 6 kHz, 9 kHz, and 12 kHz, without limitation.

Speaker-channel identifier 414 may be indicative of a role of the speaker that broadcast communication 400 in the multi-speaker system. Non-limiting examples of speaker-channel identifiers 414 include "center," "front right," "front left," "back right," and "back left."

Information 416 may be additional information for multi-speaker system. For example, information 416 may include information such as speaker type, physical setup of the speaker, and limitations on the speaker.

Table 1 includes example information regarding a system according to one or more examples. Table 1 includes a column of speaker-channel identifiers and speaker settings associated with each of the speaker-channel identifiers. A speaker (e.g., one or more of speaker 100 of FIG. 1, speaker 200 of FIG. 2, first speaker 302 of FIG. 3, second speaker 304, of FIG. 3, and third speaker 306 of FIG. 3) may adjust its speaker settings according to information similar to Table 1 based on a determined speaker-channel identifier. As a non-limiting example, responsive to a determination that a speaker (e.g., first speaker 302 of FIG. 3) is a "center" speaker, the speaker may select "center" as its audio channel, adjust its frequency range to 60 Hertz (Hz) to 20 kHz, and set its volume level (or relative volume level) to 60%.

TABLE 1

| Speaker-Channel Identifier | Audio Channel | Frequency Range | Volume |
|---|---|---|---|
| Center (C) | Center | 60 Hz-20 kHz | 60% |
| Front High Right (FHR) | Right Center | 50 Hz-20 kHz | 25% |
| Front High Left (FHL) | Left Center | 50 Hz-20 kHz | 25% |
| Subwoofer (SW) | Sub | 20 Hz-150 Hz | 50% |
| Front Right (FR) | Right Center | 50 Hz-20 kHz | 25% |
| Front Left (FL) | Left Center | 50 Hz-20 kHz | 25% |
| Side Right (SR) | Right Surround | 50 Hz-20 kHz | 40% |
| Side Left (SL) | Left Surround | 50 Hz-20 kHz | 40% |
| Side Back Right (SBR) | Right Point Surround | 50 Hz-20 kHz | 40% |
| Side Back Left (SBL) | Left Point Surround | 50 Hz-20 kHz | 40% |

Figure 5:
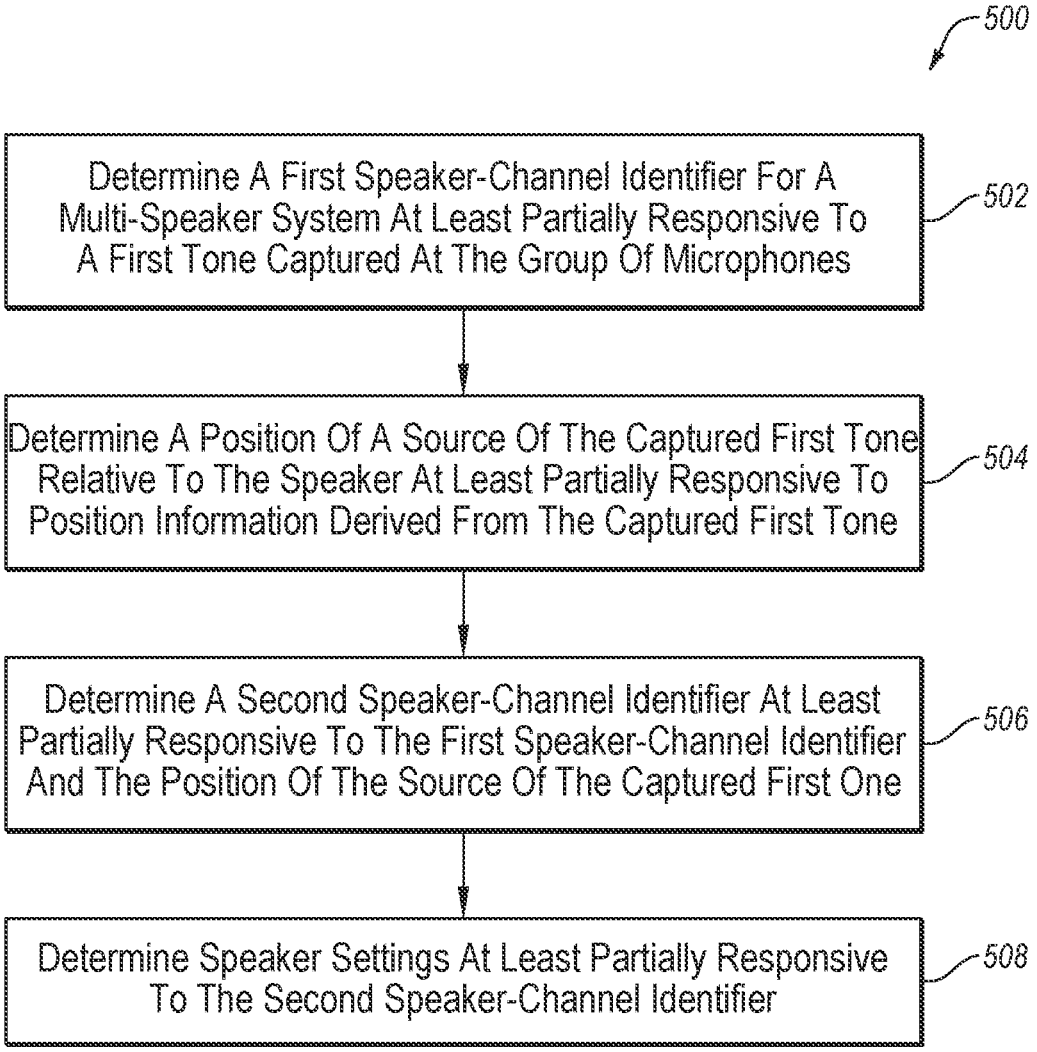
FIG. 5 is a flowchart illustrating an example method, according to one or more examples.

FIG. 5 is a flowchart illustrating an example method 500, according to one or more examples. At least a portion of method 500 may be performed, in various examples, by a speaker or system, such as one or more of speaker 100 of FIG. 1, speaker 200 of FIG. 2, multi-speaker system 300 of FIG. 3, first speaker 302 of FIG. 3, second speaker 304, of FIG. 3, and third speaker 306 of FIG. 3, or another device or system. Although illustrated as discrete blocks, various blocks may be divided into additional blocks, combined into fewer blocks, or eliminated, depending on the desired implementation.

A speaker (e.g., one of first speaker 302, second speaker 304, and third speaker 306 of FIG. 3) may perform operations at each of block 502, block 504, block 506, and block 508. An other speaker (e.g., an other of first speaker 302, second speaker 304, and third speaker 306 of FIG. 3) may perform other operations that are not part of method 500, e.g., broadcasting information about the other speaker and outputting a tone at a tone frequency, without limitation.

At block 502, a first speaker-channel identifier for an other speaker of a multi-speaker system may be determined at least partially responsive to a first tone captured at a group of microphones of a speaker. The first tone may have been output by the other speaker (i.e., not the speaker performing operations at block 502). The first speaker-channel identifier may be a speaker-channel identifier of the other speaker. Determining the first speaker-channel identifier may involve associating the first speaker-channel identifier with the first tone based on a tone frequency of the first tone and an association between the tone frequency and the first speaker-channel identifier. The association between the tone frequency and the first speaker-channel identifier may be pre-specified. Additionally or alternatively, the association between the tone frequency and the first speaker-channel identifier may have been included in information broadcast, e.g., by the other speaker, without limitation.

At block 504, a position of a source of the captured first tone relative to the speaker (e.g., the speaker performing operations at block 504) may be determined at least partially responsive to position information derived from the captured first tone. The position information derived from the captured first tone may include one or more of a time of arrival and a volume of the captured first tone at each microphone of a group of microphones. The determined position may represent (at the speaker performing operations at block 504) a relative position of the other speaker (i.e., the speaker that output the first tone).

At block 506 a second speaker-channel identifier may be determined at least partially responsive to the first speaker-channel identifier and the position of the source of the captured first tone. The second speaker-channel identifier may be a speaker-channel identifier of the speaker performing operations at block 506. The second speaker-channel identifier may be determined based on the speaker-channel identifier of the other speaker and the determined relative position of the other speaker. As a non-limiting example, a speaker performing operations at block 506 may determine that the speaker is a "side left" speaker based on having determined that the other speaker is to the right and the other speaker has a speaker-channel identifier of "side right."

At block 508, speaker settings may be determined at least partially responsive to the second speaker-channel identifier. As a non-limiting example, based on a determination that the speaker is a "side left" speaker, the speaker may determine appropriate speaker settings. In various examples, the speaker may apply the speaker settings to itself.

Figure 6:
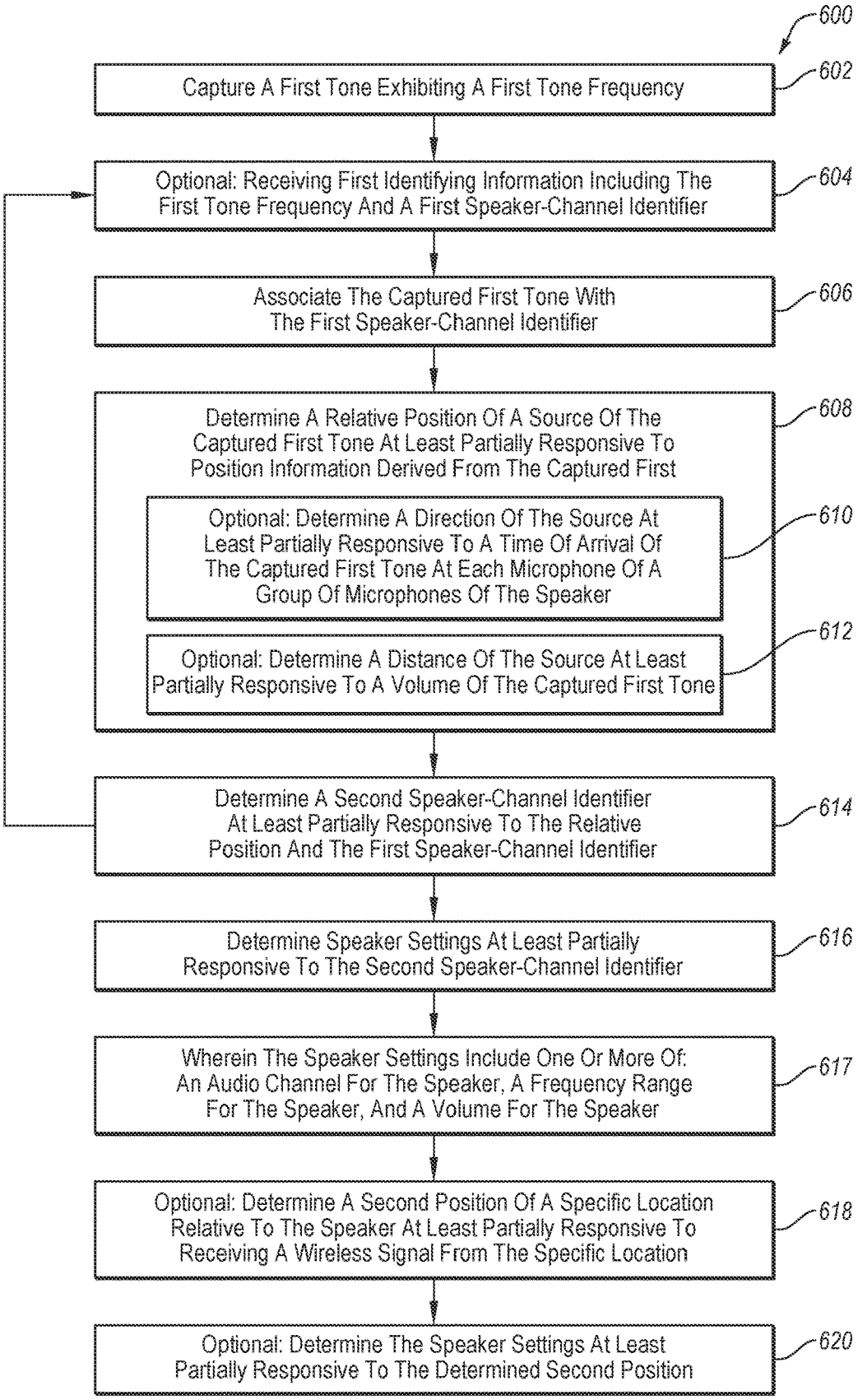
FIG. 6 is a flowchart illustrating an example method, according to one or more examples.

FIG. 6 is a flowchart illustrating an example method 600, according to one or more examples. At least a portion of method 600 may be performed, in various examples, by a device or system, such as one or more of speaker 100 of FIG. 1, speaker 200 of FIG. 2, multi-speaker system 300 of FIG. 3, first speaker 302 of FIG. 3, second speaker 304, of FIG. 3, and third speaker 306 of FIG. 3, or another device or system. Although illustrated as discrete blocks, various blocks may be divided into additional blocks, combined into fewer blocks, or eliminated, depending on the desired implementation.

A speaker (e.g., one of first speaker 302, second speaker 304, and third speaker 306 of FIG. 3) may perform operations at each of block 602, block 606, block 608, block 614, and block 616. Additionally, the speaker may perform operations at one or more of block 604, block 610, block 612, block 618, and block 620, each of which is optional in method 600. An other speaker (e.g., an other of first speaker 302, second speaker 304, and third speaker 306 of FIG. 3) may perform other operations that are not part of method 600, e.g., broadcasting information about the other speaker and outputting a tone at a tone frequency, without limitation.

At block 602, a first tone may be captured. The first tone may exhibit a first tone frequency. The first tone may have been output by the other speaker.

At block 604, which is optional, first identifying information may be received. The first identifying information may include the first tone frequency and a first speaker-channel identifier (and an association therebetween). The first identifying information may be received from the other speaker (i.e., not the speaker performing operations at block 604). As a non-limiting example, the other speaker may have broadcast the first identifying information (e.g., in a wireless signal, without limitation). The first speaker-channel identifier may be of the other speaker. Alternatively, the first identifying information may be pre-stored in a memory of the speaker.

At block 606, the captured first tone may be associated with the first speaker-channel identifier. The captured first tone may be associated with the first speaker-channel identifier based on the first tone exhibiting the first tone frequency and an association between the first speaker-channel identifier and the first tone frequency (e.g., based on the inclusion of the first tone frequency and the first speaker-channel identifier in the identifying information received at block 604, without limitation).

At block 608, a relative position of a source of the first captured tone may be determined at least partially responsive to position information derived from the captured first tone.

At block 610, which is optional, which may be a sub-block of block 608, a direction of the source may be determined at least partially responsive to a time of arrival of the captured first tone at each microphone of a group of microphones of the speaker (i.e., the speaker performing operations at block 610).

At block 612, which is optional, which may be a sub-block of block 608, a distance of the source from the speaker (i.e., the speaker performing operations at block 612) may be determined at least partially responsive to a volume of the captured first tone at the group of microphones.

At block 614, a second speaker-channel identifier may be determined at least partially responsive to the relative position and the first speaker-channel identifier. The second speaker-channel identifier may be a speaker-channel identifier of the speaker performing operations at block 614. The second speaker-channel identifier may be determined based on the speaker-channel identifier of the other speaker and the relative position of the other speaker.

At block 616, speaker settings may be determined at least partially responsive to the second speaker-channel identifier.

According to block 617, which is optional, the speaker settings may include one or more of: an audio channel for the speaker, a frequency range for the speaker, and a volume for the speaker.

At block 618, which is optional, a second position of a specific location relative to the speaker (i.e., the speaker performing operations at block 618) may be determined at least partially responsive to receiving a wireless signal from the specific location. As a non-limiting example, a phone of a listener may broadcast a wireless signal or output a listener tone with a predetermined tone frequency. The speaker may determine the specific location based on the broadcast signal or the listener output tone.

At block 620, which is optional, the speaker settings (e.g., the speaker settings determined at block 616, without limitation) may be determined at least partially responsive to the determined second position.

At any point in method 600, (e.g., following block 614 without limitation) updated or additional identifying information may be received. As a non-limiting example, the other speaker may update its speaker-channel identifier and broadcast updated identifying information. Additionally or alternatively, a third speaker may broadcast identifying information. Such an occurrence may cause method 600 to function as if method 600 returns to block 604 (illustrated as the arrow between block 614 and block 604). However, in the case of receiving updated identifying information from the other speaker, it may be unnecessary to perform operations at one or more of block 608, block 610, and block 612 because the relative position of the other speaker is already known to the speaker. And, in the case of receiving additional identifying information from the third speaker, a third tone exhibiting a third tone frequency may also be captured and a position of the third speaker may be determined.

Figure 7:
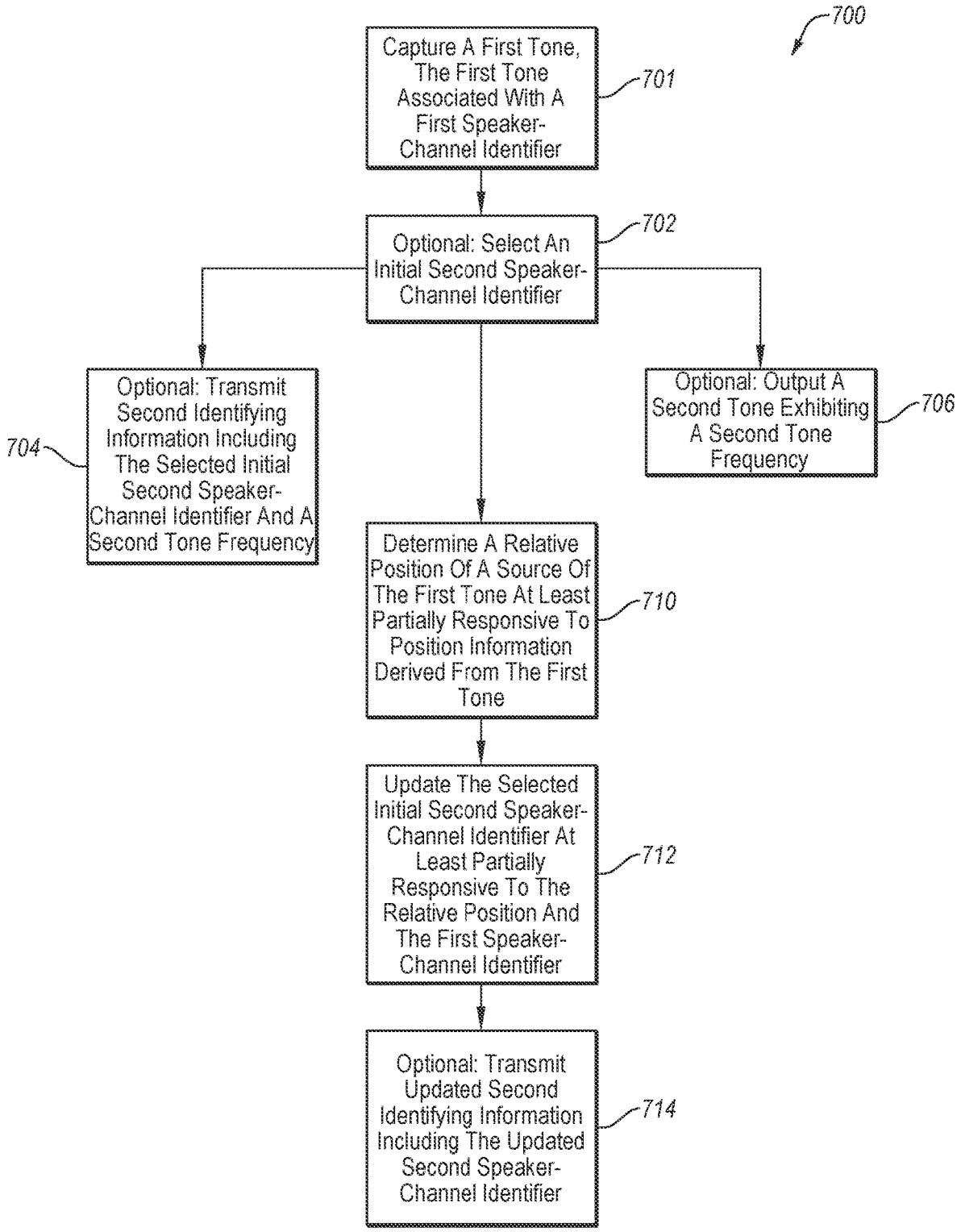
FIG. 7 is a flowchart illustrating an example method, according to one or more examples.

FIG. 7 is a flowchart illustrating an example method 700, according to one or more examples. At least a portion of method 700 may be performed, in various examples, by a device or system, such as one or more of speaker 100 of FIG. 1, speaker 200 of FIG. 2, multi-speaker system 300 of FIG. 3, first speaker 302 of FIG. 3, second speaker 304 of FIG. 3, and third speaker 306 of FIG. 3, or another device or system. Although illustrated as discrete blocks, various blocks may be divided into additional blocks, combined into fewer blocks, or eliminated, depending on the desired implementation.

A speaker (e.g., one of first speaker 302, second speaker 304, and third speaker 306 of FIG. 3) may perform operations at each of block 701, block 710, and block 712. Additionally, the speaker may perform operations at one or more of block 702, block 704, block 706, and block 714, each of which is optional in method 700. An other speaker (e.g., an other of first speaker 302, second speaker 304, and third speaker 306 of FIG. 3) may perform other operations that are not part of method 700, e.g., broadcasting information about the other speaker and outputting a tone at a tone frequency, without limitation.

At block 701, a first tone may be captured. The first tone may be associated with a first speaker-channel identifier. The first tone may have been output by the other speaker (i.e., not the speaker performing operations at block 701). The first tone may exhibit a first tone frequency that may be associated with the first speaker-channel identifier. The first tone frequency may be associated with the first speaker-channel identifier by inclusion of both the first tone frequency and the first speaker-channel identifier in first identifying information such as in a pre-specified list or in first identifying information broadcast by the other speaker, without limitation.

At block 702, which is optional, an initial second speaker-channel identifier may be selected. The initial second speaker-channel identifier may be a speaker-channel identifier of the speaker performing operations at block 702.

At block 704, which is optional, second identifying information may be transmitted (e.g., broadcast, without limitation). The second identifying information may include the selected initial second speaker-channel identifier and a second tone frequency.

At block 706, which is optional, a second tone exhibiting the second tone frequency may be output.

At block 710, a relative position of a source of the first tone may be determined at least partially responsive to position information derived from the first tone.

At block 712, the selected initial second speaker-channel identifier may be updated at least partially responsive to the relative position and the first speaker-channel identifier.

At block 714, which is optional, updated second identifying information including the updated second speaker-channel identifier may be transmitted (e.g., broadcast, without limitation). The updated second speaker-channel identifier of block 712 and block 714 in method 700 may be analogous to the second speaker-channel identifier of block 506 of FIG. 5 in method 500 of FIG. 5 and/or block 614 of FIG. 6 in method 600 of FIG. 6.

Figure 8:
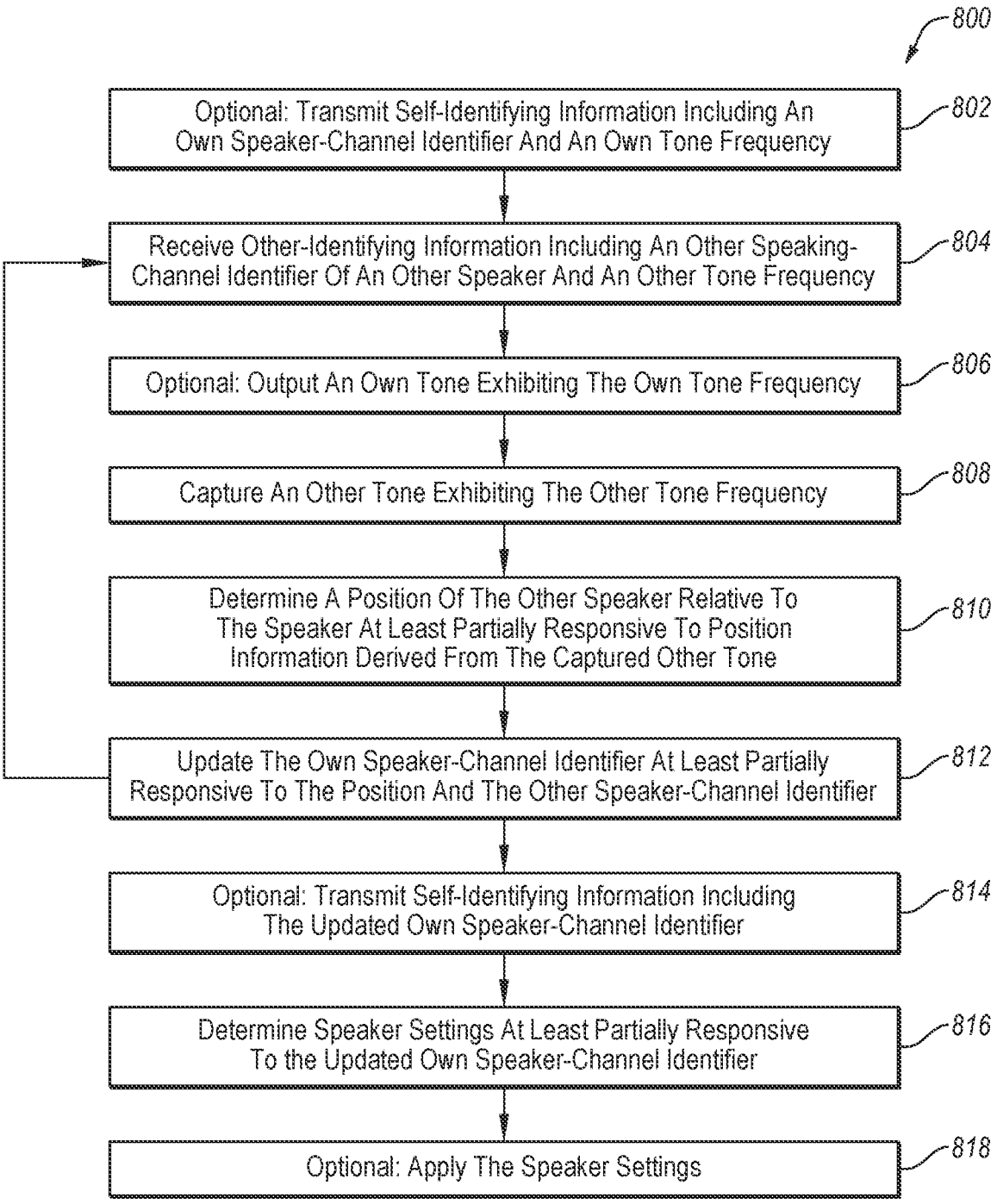
FIG. 8 is a flowchart illustrating an example method, according to one or more examples.

By performing operations at one or more of block 702, block 704, block 706, and block 714, (each of which is optional) a speaker may enable other speakers of a multi-speaker system to determine their own speaker-channel identifiers (e.g., by performing method 500 of FIG. 5, method 600 of FIG. 6, one or more of block 701, block 710, and block 712 of method 700 of FIG. 7, or one or more of block 804, block 808, block 810, and block 812 of method 800 of FIG. 8, to be described below, without limitation).

FIG. 8 is a flowchart illustrating an example method 800, according to one or more examples. At least a portion of method 800 may be performed, in various examples, by a device or system, such as one or more of speaker 100 of FIG. 1, speaker 200 of FIG. 2, multi-speaker system 300 of FIG. 3, first speaker 302 of FIG. 3, second speaker 304 of FIG. 3, and third speaker 306 of FIG. 3, or another device or system. Although illustrated as discrete blocks, various blocks may be divided into additional blocks, combined into fewer blocks, or eliminated, depending on the desired implementation.

A speaker (e.g., one of first speaker 302, second speaker 304, and third speaker 306 of FIG. 3) may perform operations at each of block 804, block 808, block 810, block 812, and block 816. Additionally, the speaker may perform operations at one or more of block 802, block 806, and block 818, each of which is optional in method 800. An other speaker (e.g., an other of first speaker 302, second speaker 304, and third speaker 306 of FIG. 3) may perform other operations that are not part of method 800, e.g., broadcasting information about the other speaker and outputting a tone at a tone frequency, without limitation.

At block 802, which is optional, self-identifying information, including an own speaker-channel identifier and an own tone frequency may be transmitted (e.g., broadcast, without limitation).

At block 804, other-identifying information including an other speaker-channel identifier of an other speaker and an other-tone frequency may be received.

At block 806, which is optional, an own tone exhibiting the own tone frequency may be output.

At block 808, an other tone exhibiting the other-tone frequency may be captured.

At block 810, a position of the other speaker relative to the speaker may be determined at least partially responsive to position information derived from the captured other tone.

At block 812, the own speaker-channel identifier may be updated at least partially responsive to the position (i.e., of the other speaker) and the other speaker-channel identifier.

At block 814, which is optional, self-identifying information including the updated own speaker-channel identifier may be transmitted (e.g., broadcast, without limitation). The updated own speaker-channel identifier of block 812 and block 814 in method 800 may be analogous to the second speaker-channel identifier of block 506 of FIG. 5 in method 500 of FIG. 5 and/or block 614 of FIG. 6 in method 600 of FIG. 6.

At block 816, speaker settings for the speaker may be determined at least partially responsive to the updated own speaker-channel identifier.

At block 818, which is optional, the speaker settings may be applied, i.e., at the speaker.

By performing operations at one or more of block 802, block 806, and block 814 (each of which is optional), a speaker may enable other speakers of a multi-speaker system to determine their own speaker-channel identifiers (e.g., by performing method 500 of FIG. 5, method 600 of FIG. 6, one or more of block 701, block 710, and block 712 of method 700 of FIG. 7, or one or more of block 804, block 808, block 810, and block 812 of method 800 of FIG. 8, without limitation).

At any point in method 800, e.g., following block 812, updated or additional identifying information may be received. As a non-limiting example, the other speaker may update its speaker-channel identifier and broadcast updated identifying information. Additionally or alternatively, a third speaker may broadcast identifying information. Such an occurrence may cause method 800 to function as if method 800 returns to block 804 (illustrated as the arrow between block 812 and block 804). However, in the case of receiving updated identifying information from the other speaker, it may be unnecessary to perform operations at one or more of block 808 and block 810 because the relative position of the other speaker is already known to the speaker. And, in the case of receiving additional identifying information from the third speaker, a third tone exhibiting a third tone frequency may also be captured and a third location of the third speaker may be determined.

Figure 9:
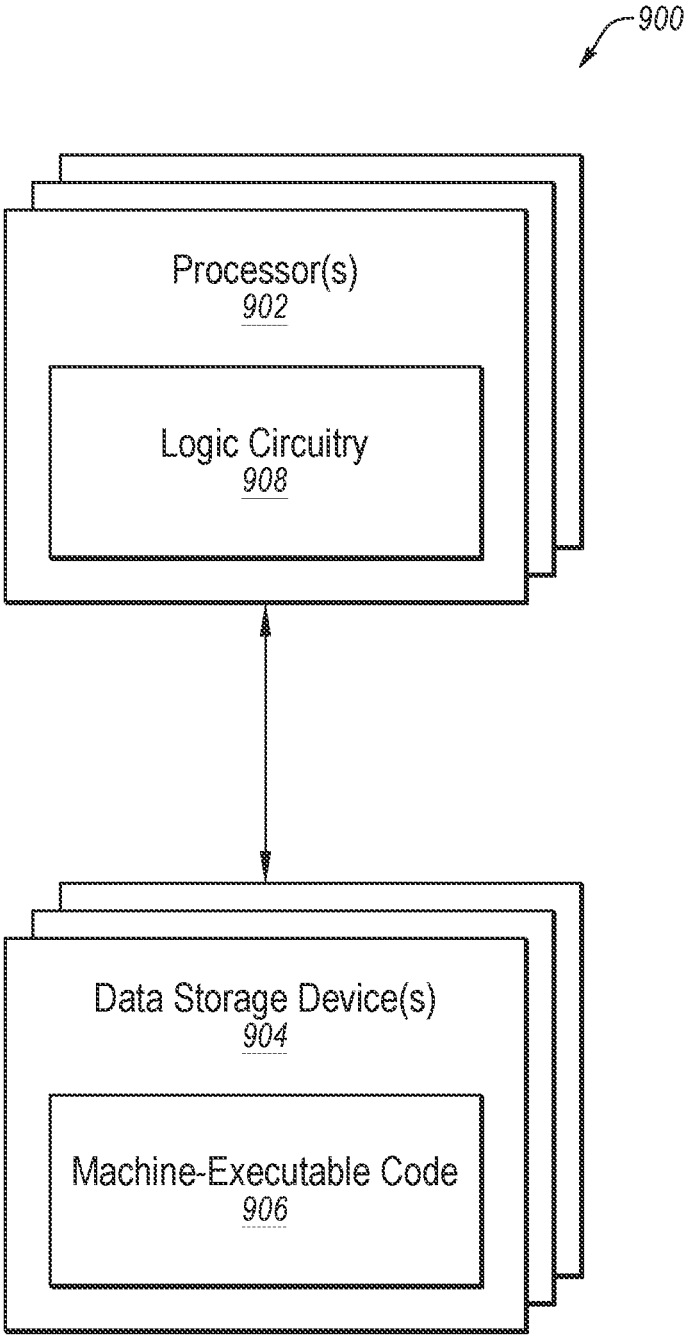
FIG. 9 illustrates a block diagram of an example device that may be used to implement various functions, operations, acts, processes, or methods, in accordance with one or more examples.

FIG. 9 is a block diagram of an example device 900 that, in various examples, may be used to implement various functions, operations, acts, processes, or methods disclosed herein. Device 900 includes one or more processors 902 (sometimes referred to herein as "processors 902") operably coupled to one or more apparatuses such as data storage devices (sometimes referred to herein as "storage 904"), without limitation. Storage 904 includes machine executable code 906 stored thereon (e.g., stored on a computer-readable memory) and processors 902 include logic circuitry 908. Machine executable code 906 may include information describing functional elements that may be implemented by (e.g., performed by) logic circuitry 908. Logic circuitry 908 is adapted to implement (e.g., perform) the functional elements described by machine executable code 906. Device 900, when executing the functional elements described by machine executable code 906, should be considered as special purpose hardware configured for carrying out the functional elements disclosed herein. In various examples, processors 902 may perform the functional elements described by machine executable code 906 sequentially, concurrently (e.g., on one or more different hardware platforms), or in one or more parallel process streams.

When implemented by logic circuitry 908 of processors 902, machine executable code 906 is configured to adapt processors 902 to perform operations of examples disclosed herein. For example, machine executable code 906 may adapt processors 902 to perform at least a portion or a totality of method 500 of FIG. 5, method 600 of FIG. 6, method 700, of FIG. 7, or method 800 of FIG. 8. As another example, machine executable code 906 may adapt processors 902 to perform at least a portion or a totality of the operations discussed for speaker 100 of FIG. 1, speaker 200 of FIG. 2, or multi-speaker system 300 of FIG. 3, and more specifically, one or more of processor 108 of speaker 100 of FIG. 1, processor 208 of speaker 200 of FIG. 2, first speaker 302, second speaker 304, or third speaker 306 of multi-speaker system 300 of FIG. 3.

Processors 902 may include a general purpose processor, a special purpose processor, a central processing unit (CPU), a microcontroller, a programmable logic controller (PLC), a digital signal processor (DSP), an application specific integrated circuit (ASIC), a field-programmable gate array (FPGA) or other programmable logic device, discrete gate or transistor logic, discrete hardware components, other programmable device, or any combination thereof designed to perform the functions disclosed herein. A general-purpose computer including a processor is considered a special-purpose computer while the general-purpose computer is configured to execute computing instructions (e.g., software code) related to examples of the present disclosure. It is noted that a general-purpose processor (may also be referred to herein as a host processor or simply a host) may be a microprocessor, but in the alternative, processors 902 may include any conventional processor, controller, microcontroller, or state machine. Processors 902 may also be implemented as a combination of computing devices, such as a combination of a DSP and a microprocessor, a plurality of microprocessors, one or more microprocessors in conjunction with a DSP core, or any other such configuration.

In various examples, storage 904 includes volatile data storage (e.g., random-access memory (RAM)), non-volatile data storage (e.g., Flash memory, a hard disc drive, a solid state drive, erasable programmable read-only memory (EPROM), without limitation). In various examples, processors 902 and storage 904 may be implemented into a single device (e.g., a semiconductor device product, a system on chip (SOC), without limitation). In various examples, processors 902 and storage 904 may be implemented into separate devices.

In various examples, machine executable code 906 may include computer-readable instructions (e.g., software code, firmware code). By way of non-limiting example, the computer-readable instructions may be stored by storage 904, accessed directly by processors 902, and executed by processors 902 using at least logic circuitry 908. Also by way of non-limiting example, the computer-readable instructions may be stored on storage 904, transmitted to a memory device (not shown) for execution, and executed by processors 902 using at least logic circuitry 908. Accordingly, in various examples, logic circuitry 908 includes electrically configurable logic circuitry.

In various examples, machine executable code 906 may describe hardware (e.g., circuitry) to be implemented in logic circuitry 908 to perform the functional elements. This hardware may be described at any of a variety of levels of abstraction, from low-level transistor layouts to high-level description languages. At a high-level of abstraction, a hardware description language (HDL) such as an Institute of Electrical and Electronics Engineers (IEEE) Standard hardware description language (HDL) may be used, without limitation. By way of non-limiting examples, Verilog™, SystemVerilog™ or very large scale integration (VLSI) hardware description language (VHDL™) may be used.

HDL descriptions may be converted into descriptions at any of numerous other levels of abstraction as desired. As a non-limiting example, a high-level description can be converted to a logic-level description such as a register-transfer language (RTL), a gate-level (GL) description, a layout-level description, or a mask-level description. As a non-limiting example, micro-operations to be performed by hardware logic circuits (e.g., gates, flip-flops, registers, without limitation) of logic circuitry 908 may be described in a RTL and then converted by a synthesis tool into a GL description, and the GL description may be converted by a placement and routing tool into a layout-level description that corresponds to a physical layout of an integrated circuit of a programmable logic device, discrete gate or transistor logic, discrete hardware components, or combinations thereof. Accordingly, in various examples, machine executable code 906 may include an HDL, an RTL, a GL description, a mask level description, other hardware description, or any combination thereof.

In examples where machine executable code 906 includes a hardware description (at any level of abstraction), a system (not shown, but including storage 904) may be configured to implement the hardware description described by machine executable code 906. By way of non-limiting example, processors 902 may include a programmable logic device (e.g., an FPGA or a PLC) and the logic circuitry 908 may be electrically controlled to implement circuitry corresponding to the hardware description into logic circuitry 908. Also by way of non-limiting example, logic circuitry 908 may include hard-wired logic manufactured by a manufacturing system (not shown, but including storage 904) according to the hardware description of machine executable code 906.

Regardless of whether machine executable code 906 includes computer-readable instructions or a hardware description, logic circuitry 908 is adapted to perform the functional elements described by machine executable code 906 when implementing the functional elements of machine executable code 906. It is noted that although a hardware description may not directly describe functional elements, a hardware description indirectly describes functional elements that the hardware elements described by the hardware description are capable of performing.

As used in the present disclosure, the terms "module" or "component" may refer to specific hardware implementations configured to perform the actions of the module, component, software objects or software routines that may be stored on or executed by general purpose hardware (e.g., computer-readable media, processing devices, without limitation) of the computing system. In various examples, the different components, modules, engines, and services described in the present disclosure may be implemented as objects or processes that execute on the computing system (e.g., as separate threads). While some of the system and methods described in the present disclosure are generally described as being implemented in software (stored on or executed by general purpose hardware), specific hardware implementations or a combination of software and specific hardware implementations are also possible and contemplated.

As used in the present disclosure, the term "combination" with reference to a plurality of elements may include a combination of all the elements or any of various different sub-combinations of some of the elements. For example, the phrase "A, B, C, D, or combinations thereof" may refer to any one of A, B, C, or D; the combination of each of A, B, C, and D; and any sub-combination of A, B, C, or D such as A, B, and C; A, B, and D; A, C, and D; B, C, and D; A and B; A and C; A and D; B and C; B and D; or C and D.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to").

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C" or "one or more of A, B, and C" is used, in general such a construction is intended to include A alone, B alone, C alone, A and B together, A and C together, B and C together, or A, B, and C together.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additional non-limiting examples of the disclosure may include:

Example 1: A speaker comprising: a group of microphones; and a processor to: determine a first speaker-channel identifier for a multi-speaker system at least partially responsive to a first tone captured at the group of microphones; determine a position of a source of the captured first tone relative to the speaker at least partially responsive to position information derived from the captured first tone; determine a second speaker-channel identifier at least partially responsive to the first speaker-channel identifier and the position of the source of the captured first tone; and determine speaker settings at least partially responsive to the second speaker-channel identifier.

Example 2: The speaker according to Example 1, comprising a transducer to output a second tone.

Example 3: The speaker according to Examples 1 and 2, wherein the first tone exhibits a first tone frequency and the second tone exhibits a second tone frequency, the first tone frequency different than the second tone frequency.

Example 4: The speaker according to any of Examples 1 to 3, comprising wireless communication equipment to receive information about an other speaker of the multi-speaker system.

Example 5: The speaker according to any of Examples 1 to 4, wherein the received information comprises a speaker-channel identifier and a tone frequency of the first tone.

Example 6: The speaker according to any of Examples 1 to 5, wherein the wireless communication equipment is to transmit information about the speaker.

Example 7: The speaker according to any of Examples 1 to 6, wherein the position of the source comprises a first position, wherein the speaker comprises a wireless communication equipment to receive an indication of a second position of a specific location relative to the speaker and wherein the processor is to determine the speaker settings at least partially responsive to the second position.

Example 8: The speaker according to any of Examples 1 to 7, wherein speaker settings comprise one or more of: an audio channel for the speaker; a frequency range for the speaker; and a volume for the speaker.

Example 9: The speaker according to any of Examples 1 to 8, wherein the group of microphones includes three microphones in a spaced arrangement.

Example 10: A method comprising: capturing a first tone exhibiting a first tone frequency; associating the captured first tone with a first speaker-channel identifier; determining a relative position of a source of the captured first tone at least partially responsive to a position information derived from the captured first tone; determining a second speaker-channel identifier at least partially responsive to the relative position and the first speaker-channel identifier; and determining speaker settings at least partially responsive to the second speaker-channel identifier.

Example 11: The method according to Example 10, wherein each of the first speaker-channel identifier and the second speaker-channel identifier are one of a number of specified speaker-channel identifiers.

Example 12: The method according to Examples 10 and 11, comprising receiving first identifying information including the first tone frequency and the first speaker-channel identifier.

Example 13: The method according to any of Examples 10 to 12, wherein associating the captured first tone with the first speaker-channel identifier is at least partially responsive to the received first identifying information including the first tone frequency and the captured first tone exhibiting the first tone frequency.

Example 14: The method according to any of Examples 10 to 13, wherein receiving the first identifying information comprises receiving a wireless signal including the first identifying information.

Example 15: The method according to any of Examples 10 to 14, wherein capturing the first tone comprises capturing the first tone at one or more microphones.

Example 16: The method according to any of Examples 10 to 15, wherein determining the relative position of the source of the captured first tone comprises determining a direction of the source at least partially responsive to a time of arrival of the captured first tone at each microphone of a group of microphones of the speaker.

Example 17: The method according to any of Examples 10 to 16, wherein determining the relative position of the source of the captured first tone comprises determining a distance of the source at least partially responsive to a volume of the captured first tone.

Example 18: The method according to any of Examples 10 to 17, comprising transmitting second identifying information including a second tone frequency and the determined second speaker-channel identifier.

Example 19: The method according to any of Examples 10 to 18, comprising outputting a second tone exhibiting a second tone frequency.

Example 20: The method according to any of Examples 10 to 19, comprising: prior to determining the second speaker-channel identifier, selecting an initial second speaker-channel identifier; and wherein determining the second speaker-channel identifier comprises updating the selected initial second speaker-channel identifier at least partially responsive to the relative position and the first speaker-channel identifier.

Example 21: The method according to any of Examples 10 to 20, comprising prior to determining the second speaker-channel identifier, transmitting second identifying information including the selected initial second speaker-channel identifier.

Example 22: The method according to any of Examples 10 to 21, comprising, after determining the second speaker-channel identifier, transmitting updated second identifying information including the updated second speaker-channel identifier.

Example 23: The method according to any of Examples 10 to 22, comprising determining a second position of a specific location relative to the speaker at least partially responsive to receiving a wireless signal from the specific location.

Example 24: The method according to any of Examples 10 to 23, comprising determining the speaker settings at least partially responsive to the determined second position.

Example 25: The method according to any of Examples 10 to 24, wherein the determined speaker settings comprise one or more of: an audio channel; a frequency range; and a volume.

Example 26: A method of determining speaker settings for two or more speakers of a multi-speaker system, wherein each of the two or more speakers performs the following operations: transmitting self-identifying information including an own speaker-channel identifier and an own tone frequency; receiving other-identifying information including an other speaker-channel identifier of an other speaker and an other tone frequency; outputting an own tone exhibiting the own tone frequency; capturing an other tone exhibiting the other tone frequency; determining a position of the other speaker relative to the speaker at least partially responsive to position information derived from the captured other tone; updating the own speaker-channel identifier at least partially responsive to the position and the other speaker-channel identifier; and determining speaker settings at least partially responsive to the updated own speaker-channel identifier.

While the present disclosure has been described herein with respect to certain illustrated examples, those of ordinary skill in the art will recognize and appreciate that the present invention is not so limited. Rather, many additions, deletions, and modifications to the illustrated and described examples may be made without departing from the scope of the invention as hereinafter claimed along with their legal equivalents. In addition, features from one example may be combined with features of another example while still being encompassed within the scope of the invention as contemplated by the inventor.

What is claimed is:

1. A speaker comprising:

a group of microphones; and a processor to:

determine a first speaker-channel identifier for a multi-speaker system at least partially responsive to a first tone captured at the group of microphones;

determine a position of a source of the captured first tone relative to the speaker at least partially responsive to position information derived from the captured first tone;

determine a second speaker-channel identifier at least partially responsive to the first speaker-channel identifier and the position of the source of the captured first tone; and determine speaker settings at least partially responsive to the second speaker-channel identifier.

2. The speaker of claim 1, comprising a transducer to output a second tone.

3. The speaker of claim 2, wherein the first tone exhibits a first tone frequency and the second tone exhibits a second tone frequency, the first tone frequency different than the second tone frequency.

4. The speaker of claim 1, comprising a wireless communication equipment to receive information about another speaker of the multi-speaker system.

5. The speaker of claim 4, wherein the received information comprises a speaker-channel identifier and a tone frequency of the first tone.

6. The speaker of claim 4, wherein the wireless communication equipment is to transmit information about the speaker.

7. The speaker of claim 1, wherein the position of the source comprises a first position, wherein the speaker comprises a wireless communication equipment to receive an indication of a second position of a specific location relative to the speaker and wherein the processor is to determine the speaker settings at least partially responsive to the second position.

8. The speaker of claim 1, wherein speaker settings comprise one or more of:

an audio channel for the speaker;

a frequency range for the speaker; and a volume for the speaker.

9. The speaker of claim 1, wherein the group of microphones includes three microphones in a spaced arrangement.

10. A method comprising:

capturing a first tone exhibiting a first tone frequency;

associating the captured first tone with a first speaker-channel identifier;

determining a relative position of a source of the captured first tone at least partially responsive to a position information derived from the captured first tone;

determining a second speaker-channel identifier at least partially responsive to the relative position and the first speaker-channel identifier; and determining speaker settings at least partially responsive to the second speaker-channel identifier.

11. The method of claim 10, wherein each of the first speaker-channel identifier and the second speaker-channel identifier are one of a number of specified speaker-channel identifiers.

12. The method of claim 10, comprising receiving first identifying information including the first tone frequency and the first speaker-channel identifier.

13. The method of claim 12, wherein associating the captured first tone with the first speaker-channel identifier is at least partially responsive to the received first identifying information including the first tone frequency and the captured first tone exhibiting the first tone frequency.

14. The method of claim 12, wherein receiving the first identifying information comprises receiving a wireless signal including the first identifying information.

15. The method of claim 10, wherein capturing the first tone comprises capturing the first tone at one or more microphones.

16. The method of claim 10, wherein determining the relative position of the source of the captured first tone comprises determining a direction of the source at least partially responsive to a time of arrival of the captured first tone at each microphone of a group of microphones of the speaker.

17. The method of claim 10, wherein determining the relative position of the source of the captured first tone comprises determining a distance of the source at least partially responsive to a volume of the captured first tone.

18. The method of claim 10, comprising transmitting second identifying information including a second tone frequency and the determined second speaker-channel identifier.

19. The method of claim 10, comprising outputting a second tone exhibiting a second tone frequency.

20. The method of claim 10, comprising: prior to determining the second speaker-channel identifier, selecting an initial second speaker-channel identifier; and wherein determining the second speaker-channel identifier comprises updating the selected initial second speaker-channel identifier at least partially responsive to the relative position and the first speaker-channel identifier.

21. The method of claim 20, comprising prior to determining the second speaker-channel identifier, transmitting second identifying information including the selected initial second speaker-channel identifier.

22. The method of claim 20, comprising after determining the second speaker-channel identifier, transmitting updated second identifying information including the updated second speaker-channel identifier.

23. The method of claim 10, comprising determining a second position of a specific location relative to the speaker at least partially responsive to receiving a wireless signal from the specific location.

24. The method of claim 23, comprising determining the speaker settings at least partially responsive to the determined second position.

25. The method of claim 10, wherein the determined speaker settings comprise one or more of:

an audio channel;

a frequency range; and a volume.

26. A method of determining speaker settings for two or more speakers of a multi-speaker system, wherein each of the two or more speakers performs the following operations:

transmitting self-identifying information including an own speaker-channel identifier and an own tone frequency;

receiving other-identifying information including an other speaker-channel identifier of an other speaker and an other tone frequency;

outputting an own tone exhibiting the own tone frequency;

capturing an other tone exhibiting the other tone frequency;

determining a position of the other speaker relative to the speaker at least partially responsive to position information derived from the captured other tone;

updating the own speaker-channel identifier at least partially responsive to the position and the other speaker-channel identifier; and determining speaker settings at least partially responsive to the updated own speaker-channel identifier.

* * * * *